US009799253B2

(12) United States Patent
Wang

(10) Patent No.: US 9,799,253 B2
(45) Date of Patent: Oct. 24, 2017

(54) PIXEL STRUCTURE, DISPLAY SUBSTRATE AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventor: Zhidong Wang, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 104 days.

(21) Appl. No.: 14/775,054

(22) PCT Filed: Mar. 18, 2015

(86) PCT No.: PCT/CN2015/074508
§ 371 (c)(1),
(2) Date: Sep. 11, 2015

(87) PCT Pub. No.: WO2016/058326
PCT Pub. Date: Apr. 21, 2016

(65) Prior Publication Data

US 2016/0300520 A1 Oct. 13, 2016

(30) Foreign Application Priority Data

Oct. 14, 2014 (CN) ..... 2014 1 0542180

(51) Int. Cl.
*G09G 3/20* (2006.01)
*G09F 9/30* (2006.01)

(52) U.S. Cl.
CPC ..... *G09G 3/2003* (2013.01); *G09F 9/30* (2013.01); *G09G 2300/0452* (2013.01); *G09G 2320/0233* (2013.01); *G09G 2320/0242* (2013.01)

(58) Field of Classification Search
CPC ..... G09G 3/2003; G09G 2300/0452; G09G 2320/0233; G09G 2320/0242; G09F 9/30
(Continued)

(56) References Cited

U.S. PATENT DOCUMENTS 5,311,337 A 5/1994 McCartney, Jr.
2015/0009104 A1* 1/2015 Kim ..... G09G 3/3225 345/76

(Continued)

FOREIGN PATENT DOCUMENTS

CN 101153932 A 4/2008
CN 101211518 A 7/2008

(Continued)

OTHER PUBLICATIONS

First Chinese Office Action dated May 6, 2016; Appln. No. 201410542180.6.
Second Chinese Office Action dated Sep. 6, 2016; Appln. No. 201410542180.6.

(Continued)

*Primary Examiner* — Mark Regn
(74) *Attorney, Agent, or Firm* — Ladas & Parry LLP

(57) ABSTRACT

A pixel structure, a display substrate and a display device are disclosed. The pixel structure includes a plurality of reduplicated units, wherein each of the reduplicated units includes: a red sub-pixel (A1), a green sub-pixel (A2), a blue sub-pixel (A3) and a central sub-pixel (W) all in a shape of a triangle, wherein a color of the central sub-pixel (W) is different from that of any of the red sub-pixel (A1), the green sub-pixel (A2) and the blue sub-pixel (A3), and the three sides of the central sub-pixel (W) respectively coincide with (Continued)

one side of the red sub-pixel (A1), one side of the green sub-pixel (A2) and one side of the blue sub-pixel (A3). By designing the shape of the sub-pixel unit to be a triangle, it is possible to allow the red, green and blue sub-pixels (A1, A2, A3) surrounding the three sides of the central sub-pixel (W) and to guarantee the central sub-pixel (W) to be adjacent to the other three sub-pixels (A1, A2, A3), thus increasing the luminance while realizing homogeneous color mixing of different colors of sub-pixels, thereby improving the display quality.

9 Claims, 4 Drawing Sheets

(58) Field of Classification Search
USPC ..... 345/55
See application file for complete search history.

(56) References Cited

U.S. PATENT DOCUMENTS

2015/0116375 A1* 4/2015 Yang ..... G09G 3/2003 345/690
2015/0348470 A1 12/2015 Wang et al.

FOREIGN PATENT DOCUMENTS

| | | | |
|---|---|---|---|
| CN | 202285072 U | | 6/2012 |
| CN | 202887618 U | * | 4/2013 |
| CN | 104050889 A | | 9/2014 |
| CN | 104299523 A | | 1/2015 |

OTHER PUBLICATIONS

International Search Report and Written Opinion both dated Jul. 1, 2015: PCT/CN2015/014508.

* cited by examiner

PIXEL STRUCTURE, DISPLAY SUBSTRATE AND DISPLAY DEVICE

FIELD OF THE ART

Embodiments of the invention relate to a pixel structure, a display substrate and a display device.

BACKGROUND

A tricolor sub-pixel structure of red, green and blue (i.e., RGB) is used in conventional display panels. To meet the requirement of high luminance and low power consumption, a sub-pixel structure in four colors (red, green, blue and white, i.e., RGBW) is proposed in the industry. By introducing the white (W) transparent sub-pixel, it can increase the luminance of the display panels, thereby reducing the power consumption.

In a conventional pixel, the RGBW four-color sub-pixels are generally arranged into two configurations of strips or a checkerboard. FIGS. 1 and 2 schematically illustrate a structure of the RGBW four-color sub-pixels being arranged as strips, and FIG. 3 schematically illustrates a structure of the RGBW four-color sub-pixels being arranged as the checkerboard. In a strip arrangement, when R, C and B sub-pixels are disposed as adjacent to each other, a W sub-pixel can only be adjacent to one of the R, G, or B sub-pixels. As illustrated in FIG. 1, the W sub-pixel can only be adjacent to the B sub-pixel. When the W sub-pixel is disposed between two of the R, G, and B sub-pixels, the W sub-pixel is adjacent to that two sub-pixels both. As illustrated in FIG. 2, the W sub-pixel is disposed between the G and B sub-pixels and is adjacent to the G and B sub-pixels.

SUMMARY

A first aspect of the invention provides a pixel structure comprising a plurality of reduplicated units, wherein each of the reduplicated units comprises: a red sub-pixel, a green sub-pixel, a blue sub-pixel and a central sub-pixel all in a shape of a triangle, wherein a color of the central sub-pixel is different from that of any of the red, green and blue sub-pixels, and the three sides of the central sub-pixel respectively coincide with one side of the red sub-pixel, one side of the green sub-pixel and one side of the blue sub-pixel.

As an example, the color of the central sub-pixel is yellow or white.

As an example, the red sub-pixel, the green sub-pixel, the blue sub-pixel and the central sub-pixel are all in a shape of equilateral triangle.

As an example, each of the reduplicated units comprises a first pixel unit, and the first pixel unit comprises a red sub-pixel, a green sub-pixel, a blue sub-pixel and a central sub-pixel.

As an example, each of the reduplicated units further comprises: a second pixel unit, wherein the second pixel units and the first pixel units are central symmetric and together form a reduplicated unit having a shape of rhombus.

As an example, the red sub-pixel, the green sub-pixel, the blue sub-pixel and the central sub-pixel are all in a shape of isosceles right triangle.

As an example, each of the reduplicated units comprises a third pixel unit, wherein the third pixel unit comprises a red sub-pixel, a green sub-pixel, a blue sub-pixel and a central sub-pixel.

As an example, each of the reduplicated units further comprises: a fourth pixel unit, wherein the fourth pixel units and the third pixel units are central symmetric and together form a reduplicated unit having a shape of square.

As an example, a hypotenuse of the central sub-pixel coincides with a hypotenuse of the blue sub-pixel.

Another aspect of the invention provides a display substrate comprising a substrate and a pixel structure formed on the substrate, wherein the pixel structure is the above pixel structure.

Still another aspect of the invention provides a display device comprising the display substrate.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

Figure 1:
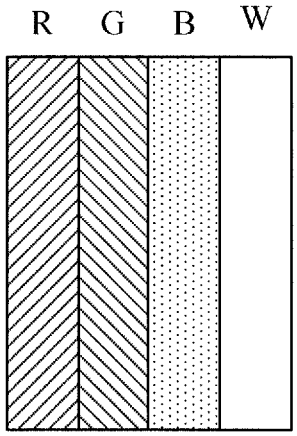
FIG. 1 schematically illustrates a conventional pixel unit having a strip arrangement structure.
Figure 2:
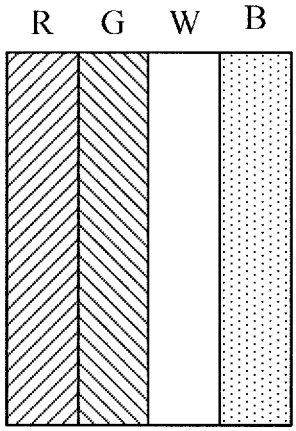
FIG. 2 schematically illustrates another conventional pixel unit having a strip arrangement structure.
Figure 3:
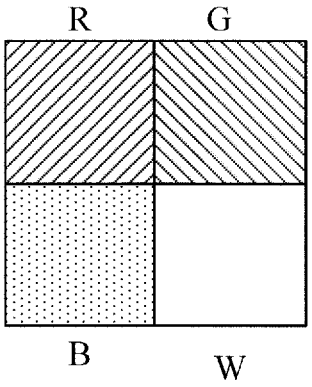
FIG. 3 schematically illustrates another conventional pixel unit having a checkerboard arrangement structure.

In a conventional pixel structure, whether being at an edge (FIG. 1) or at the center (FIG. 2), a W sub-pixel is adjacent to at most two sub-pixels of R, G and R three-color sub-pixels, making it impossible for at least one sub-pixel (the R and G sub-pixels of in FIG. 1, the R sub-pixel of in FIG. 2) to be adjacent to the W sub-pixel, as a result, inhomogeneous color mixing is caused. In a checkerboard arrangement structure as illustrated in FIG. 3, whatever order is used, a W sub-pixel is at most adjacent to two sub-pixels of R, G and R three-color sub-pixels (such as the B and G sub-pixels), with still a sub-pixel of a certain color (the R sub-pixel) not adjacent to W sub-pixel, and the problem of inhomogeneous color mixing will also arise. Due to the above fact, the above pixel structures will cause the problem of inhomogeneous color mixing, thereby compromising the display quality of the display.

In order to clearly illustrate the technical solution of the embodiments of the invention, the drawings of the embodiments will be briefly described in the following; it is obvious that the described drawings are only related to some embodiments of the invention and thus are not limitative of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but to distinguish various components.

An embodiment of the invention provides a pixel structure comprising a plurality of reduplicated units, wherein each of the reduplicated units comprises:

a red sub-pixel, a green sub-pixel, a blue sub-pixel and a central sub-pixel all having a shape of triangle, wherein a color of the central sub-pixel is different from that of any of the red, green and blue sub-pixels, and the three sides of the central sub-pixel respectively coincide with one side of the red sub-pixel, one side of the green sub-pixel and one side of the blue sub-pixel respectively. The term "coincide" in the embodiment of the invention means that two adjacent sides are in a state of being very close to and even totally coincide with each other. The meaning of "coincide" may be more clearly understood with reference to the drawings of the embodiment of the invention.

It is noted that the color of the central sub-pixel can be yellow or white. In general, by disposing a sub-pixel having a color different from red, green or blue in the center of the red, green and blue sub-pixels, it can achieve a better color mixing effect. In specific applications yellow or white which is quite different from red, green and blue is normally used.

By modifying sub-pixels in the shape of rectangular in the conventional pixel unit and designing the sub-pixels to be in a shape of triangle, it allows the red, green and blue sub-pixels to surround the three sides of the central sub-pixel, guaranteeing the central sub-pixel to be adjacent to all other three sub-pixels, thereby prevent the color mixing problem caused by one of the red, green and blue sub-pixels not being adjacent to the central sub-pixel. As a result, the luminance is increased, while the colors of sub-pixels are mixed homogeneously, thereby increasing the display quality.

Example 1

Figure 4:
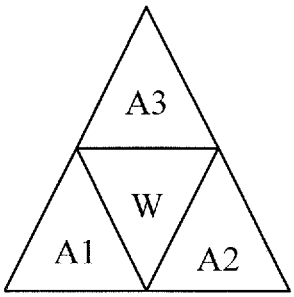
FIG. 4 schematically illustrates an arrangement structure of a first pixel unit in accordance with an embodiment of the invention.

The example provides a pixel structure comprising a plurality of reduplicated units, each of the reduplicated units comprises a red sub-pixel R, a green sub-pixel G, a blue sub-pixel B and a central sub-pixel W all having a shape of a triangle. As an example, the red sub-pixel R, the green sub-pixel G, the blue sub-pixel B and the central sub-pixel W are all in a shape of an equilateral triangle. The arrangement of the respective sub-pixels is illustrated in FIG. 4.

Each of the plurality of reduplicated units comprises a first pixel unit, the first pixel unit comprises a red sub-pixel R, a green sub-pixel G, a blue sub-pixel B and a central sub-pixel W. As illustrated in FIG. 4, A1, A2 and A3 are respectively the R, G and B sub-pixels, and A1, A2 and A3 form the first pixel unit.

As all of the R, G, B and W sub-pixels are equilateral triangles with sides equal to each other, the central sub-pixel W is in the center, the red sub-pixel R, the green sub-pixel G and the blue sub-pixel B are disposed around the central sub-pixel W, the three sides of the central sub-pixel W coincides with the R, G and B sub-pixel respectively, thereby the four sub-pixels of the first pixel unit form a new equilateral triangle, wherein a length of a side of the new equilateral triangle is twice that of any of the sub-pixels.

It is noted that, as long as the central sub-pixel W is disposed at the center (that is, the three sides of the central sub-pixel W coincides with the three sub-pixels respectively), the arrangement order of the other three sub-pixels is not defined. That is, the R, G and B sub-pixels may respectively correspond to the A1, A2, and A3. Or else, the R, G and B sub-pixels may respectively correspond to the A2, A3 and A1, or the R, G and B sub-pixels may respectively correspond to the A3, A1 and A2.

Figure 5:
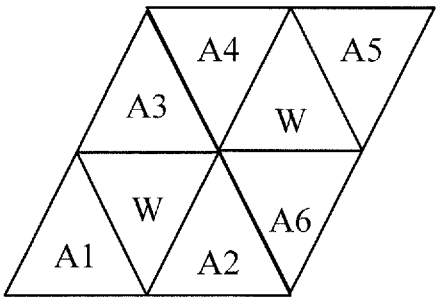
FIG. 5 schematically illustrates a structure of a sub-pixel in a reduplicated pixel unit in accordance with an embodiment of the invention.

As an example, the reduplicated unit further comprises:

A second pixel unit, wherein the second pixel unit and the first pixel unit are central symmetric and together form a reduplicated unit having a shape of rhombus. The pixel structure of the reduplicated unit of the embodiment of the invention is schematically illustrated in FIG. 5. As illustrated in FIG. 5, A4, A5 and A6 are respectively the R, G and B sub-pixels and form a second pixel unit.

Figure 6:
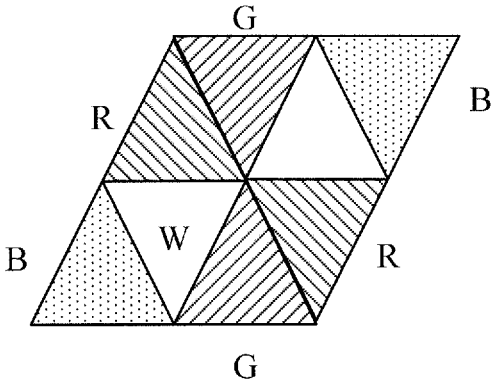
FIG. 6 schematically illustrates an arrangement structure of colors in a sub-pixel in accordance with an embodiment of the invention.

As an example, when the R, G and B sub-pixels respectively correspond to the A3, A2 and A1 of FIG. 4 and to the A6, A4 and A5 of FIG. 5, the pixel unit having a shape of rhombus and comprising the two pixel units is as illustrated in FIG. 6. As the central sub-pixel W disposed in the center can be adjacent to the R, G and B sub-pixels at the same time, a homogeneous color mixing is guaranteed and the display quality is increased.

It is noted that, the first pixel unit can form a single pixel by itself, or form a pixel unit together with the second pixel unit. In other words, the reduplicated unit may comprise the first pixel unit; it may also comprise the first and second pixel units. In terms of the color mixing effect, a reduplicated unit formed by the first and second pixel units has a better performance. As the reduplicated unit comprises the first pixel unit and the second pixel unit which are central symmetric, one side of the red sub-pixel R is adjacent to the central sub-pixel W in the same reduplicated unit and another side of the red sub-pixel R is adjacent to the green sub-pixel G of another pixel unit, thereby preventing a poor color mixing effect caused by two red sub-pixels (or green sub-pixels, or blue sub-pixels) being adjacent to each other, guaranteeing a good color mixing effect.

In summary, the pixel structure provided by the embodiment of the invention changes the shape of the existing pixel unit from rectangle to triangle, thereby solving the problem of inhomogeneous color mixing caused by a sub-pixel of a certain color always being not adjacent to the central sub-pixel accordingly in the rectangle pixel unit. The shape of triangle allows the red, green and blue sub-pixels to be around the three sides of the triangular central sub-pixel, which guarantees that the central sub-pixel is adjacent to all other sub-pixels in three colors, thus increasing the luminance while blending the colors of sub-pixels homogeneously, thereby improving the display quality.

Example 2

Figure 7:
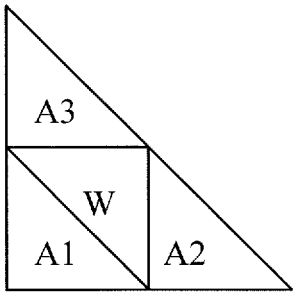
FIG. 7 schematically illustrates an arrangement structure of a third pixel unit in accordance with another embodiment of the invention.

This example is different from example 1 in that a red sub-pixel, a green sub-pixel, a blue sub-pixel and a central sub-pixel of the example are all in a shape of isosceles right triangle. The arrangement of the sub-pixels is as illustrated in FIG. 7.

Each of the reduplicated units comprises a third pixel unit. The third pixel unit comprises a red sub-pixel R, a green sub-pixel G, a blue sub-pixel B and a central sub-pixel W. As illustrated in FIG. 7, A1, A2 and A3 are respectively the R, G and B sub-pixels, and A1, A2 and A3 form the third pixel unit.

As the R, G, B and W sub-pixels are all in the shape of an isosceles right triangle with legs having a same length, the central sub-pixel W is in the center, the red sub-pixel R, the green sub-pixel G and the blue sub-pixel B are disposed around the central sub-pixel W, the three sides of the central sub-pixel W respectively coincide with the R, G and B sub-pixel, thereby the four sub-pixels of the third pixel unit form a new isosceles right triangle, wherein a length of a side of the new isosceles triangle is twice that of any of the sub-pixels.

It is noted that, as long as the central sub-pixel W is disposed at the center (that is, the three sides of the central sub-pixel W coincides with the sub-pixel respectively (including the legs and the hypotenuse)) the arrangement order of the other sub-pixels is not defined.

Figure 8:
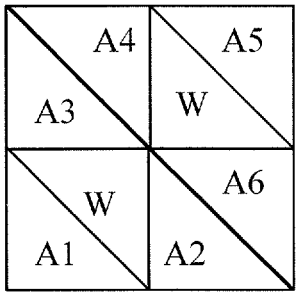
FIG. 8 schematically illustrates a structure of a sub-pixel in a reduplicated pixel unit in accordance with another embodiment of the invention.

As an example, the reduplicated unit further comprises:

A fourth pixel unit, wherein the fourth pixel unit and the third pixel unit are central symmetric and together form a reduplicated unit having a shape of square. The pixel structure of the reduplicated unit in the embodiment of the invention is as illustrated in FIG. 8. As illustrated in FIG. 8, A4, A5 and A6 are respectively R, G and B sub-pixels, and A4, A5 and A6 form the fourth pixel unit. As the three sides of the central sub-pixel W coincides with the R, G and B sub-pixels at the same time, a homogeneous color mixing is guaranteed and the display quality is increased.

It is noted that, one reduplicated unit comprises the third pixel unit and the fourth pixel unit which are central symmetric, which allows one side of the red sub-pixel R to be adjacent to the central sub-pixel W in the same reduplicated unit and another side of the red sub-pixel R to be adjacent to the green sub-pixel G of another pixel unit, thereby guaranteeing a good color mixing effect.

Figure 9:
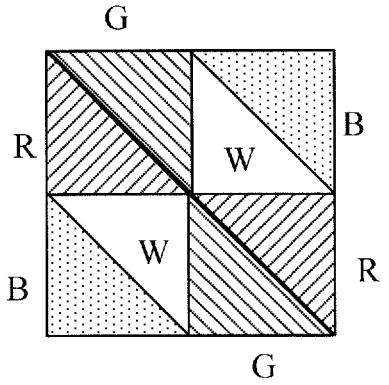
FIG. 9 schematically illustrates an arrangement structure of colors in a sub-pixel in accordance with another embodiment of the invention.

As the luminance of the blue sub-pixel B is lower than that of the red sub-pixel R and that of the green sub-pixel G, the hypotenuse of the central sub-pixel coincides with the hypotenuse of the blue sub-pixel and two legs of the central sub-pixel respectively coincide with one of legs of the red sub-pixel and one of legs of the green sub-pixel, thereby increasing a contact area between the blue sub-pixel B and the white light, which further helps to increase the luminance, as illustrated in FIG. 9.

This example can realize the same technical effect as example 1, which will not be elaborated herein. It is noted that, the above two examples are described with reference to the exemplary R/G/B/W structure. However, other arrangement structures are within the scopes of the disclosure, such as R/G/B/Y.

Another embodiment of the invention further provides a display substrate comprising a substrate and a pixel structure formed on the substrate, wherein the pixel structure is the pixel structure of any above embodiments or examples.

It is noted that, the display substrate can be color filter substrate or a color OLED substrate.

Still another embodiment of the invention further provides a display device comprising the above display substrate. The display device may be for example an E-paper, a mobile phone, a tablet PC, a television, a laptop computer, a digital photo-frame, a navigator or any products or components with a display function.

In summary, according to the pixel structure provided in the embodiments of the invention, the arrangement structure of sub-pixels of conventional pixel unit being rectangular is modified. By designing the shape of the sub-pixel as a triangle, it allows the red, green and blue sub-pixels to surround the three sides of the central sub-pixel, guaranteeing that the central sub-pixel is adjacent to the other three sub-pixels. As a result, the luminance is increased, and homogeneous color mixing of sub-pixels in different colors is realized, thereby increasing the display quality.

What is described above is related to the illustrative embodiments of the disclosure only and not limitative to the scope of the disclosure; the scopes of the disclosure are defined by the accompanying claims.

This application claims the priority of Chinese Patent Application No. 201410542180.6, filed on Oct. 14, 2014, and which application is incorporated herein by reference.

What is claimed is:

1. A pixel structure, comprising a plurality of reduplicated units, wherein each of the reduplicated units comprises:

a red sub-pixel, a green sub-pixel, a blue sub-pixel and a central sub-pixel all in a shape of a triangle, wherein a color of the central sub-pixel is different from that of any of the red sub-pixel, the green sub-pixel and the blue sub-pixel, and three sides of the central sub-pixel respectively coincide with one side of the red sub-pixel, one side of the green sub-pixel and one side of the blue sub-pixel;

wherein the red sub-pixel, the green sub-pixel, the blue sub-pixel and the central sub-pixel are all in a shape of isosceles right triangle.

2. The pixel structure of claim 1, wherein the color of the central sub-pixel is yellow or white.

3. The pixel structure of claim 1, wherein each of the reduplicated units comprises a third pixel unit, the third pixel unit comprises a red sub-pixel, a green sub-pixel, a blue sub-pixel and a central sub-pixel.

4. The pixel structure of claim 3, wherein each of the reduplicated units further comprises:

a fourth pixel unit, wherein the fourth pixel unit and the third pixel unit are central symmetric and together form a reduplicated unit having a shape of square.

5. The pixel structure of claim 4, wherein a hypotenuse of the central sub-pixel coincides with a hypotenuse of the blue sub-pixel.

6. The pixel structure of claim 3, wherein a hypotenuse of the central sub-pixel coincides with a hypotenuse of the blue sub-pixel.

7. The pixel structure of claim 1, wherein a hypotenuse of the central sub-pixel coincides with a hypotenuse of the blue sub-pixel.

8. A display substrate, comprising a substrate and a pixel structure formed on the substrate, wherein the pixel structure is the pixel structure of claim 1.

9. A display device, comprising the display substrate of claim 8.

* * * * *